US006182320B1

(12) United States Patent
Kruger et al.

(10) Patent No.: US 6,182,320 B1
(45) **Date of Patent: *Feb. 6, 2001**

(54) VIDEO DISPLAY SCREEN CLEANER

(76) Inventors: Sheldon Kruger, 12307 Greenspring Ave., Owings Mills, MD (US) 21117; Frank Stapleton, 1909 Knox Ave., Reisterstown, MD (US) 21136; Alan Vaught, 7422 Chapman Ave., Garden Grove, CA (US) 92641

( * ) Notice: Under 35 U.S.C. 154(b), the term of this patent shall be extended for 0 days.

This patent is subject to a terminal disclaimer.

(21) Appl. No.: 09/495,561

(22) Filed: Feb. 1, 2000

Related U.S. Application Data

(63) Continuation of application No. 09/268,621, filed on Mar. 15, 1999, now Pat. No. 6,058,550.

(51) Int. Cl.[7] ..... A47L 13/40; A47L 15/00

(52) U.S. Cl. ..... 15/160; 15/1.52

(58) Field of Search ..... 15/1.51, 1.52, 15/159.1, 160, 209.1, 210.1, 202

(56) References Cited

U.S. PATENT DOCUMENTS

| | | | |
|---|---|---|---|
| D. 318,762 | | 8/1991 | Rueb et al. . |
| D. 343,297 | | 1/1994 | Haines . |
| 885,276 | * | 4/1908 | McDonald . |
| 1,639,718 | * | 8/1927 | Bacorn . |
| 2,156,270 | * | 5/1939 | Smith . |
| 2,526,468 | * | 10/1950 | Frye . |
| 4,495,668 | * | 1/1985 | Adams . |
| 4,890,348 | | 1/1990 | Racioppi . |
| 5,924,153 | * | 7/1999 | Salled ..... 15/1.52 |

FOREIGN PATENT DOCUMENTS

WO 98/36662 8/1998 (WO) .

* cited by examiner

*Primary Examiner*—Randall E. Chin
(74) *Attorney, Agent, or Firm*—James G. O'Neill

(57) ABSTRACT

A hand held video display screen cleaning tool has a body with a bottom cleaning portion secured to a top gripping portion. A cleaning element is secured to the bottom portion for dusting and removing static charge from a video display screen by pressing elongated bristles on the cleaning element against and dragging the elongated bristles a multiple of times across the video display screen.

3 Claims, 1 Drawing Sheet

VIDEO DISPLAY SCREEN CLEANER

This is a continuation of pending application Ser. No. 09/268,621, filed Mar. 15, 1999, now U.S. Pat. No. 6,058, 550.

BACKGROUND OF THE INVENTION

This application claims the benefit of Document Disclosure No. 424972, dated Oct. 1, 1997, and No. 425983, dated Oct. 14, 1997.

1. Field of the Invention

This invention relates generally to cleaning devices, and more particularly, to a novel device for removing dust and static charge from cathode ray tube (CRT) screens.

2. Description of Related Art

Cleaning aids and devices, such as brushes, squeegees, ice and snow scrapers are known. These devices are widely used to clean windows and other areas in all types of buildings, and to clean and/or scrape windshields and other windows in vehicles.

However, these known devices are not capable of, and cannot be adapted for, cleaning and/or removing dust and/or static charge from computer screens. Different types of screens, such as CRT screens, are contained, for example, in computer monitors, television sets, and other video display devices. As the public becomes more familiar with and uses video display devices, such as in desk top monitors, lap top or portable computers, TV sets, etc., the need for cleaning the screens of such devices increases. Furthermore, devices for cleaning such screens should be capable of quickly and easily taking dust off of screens, and at the same time removing static charge therefrom. There, therefore, exists a need in the art for an inexpensive, easy to manufacture and use device for removing dust and static charge from video display device screens.

Known prior art devices for cleaning windows and the like are shown in U.S. Pat. Nos. 763,888 to Hayden, 1,555,417 to Johnston, 2,154,373 to Bulleigh, 2,526,468 to Frye, 2,977,127 to Mertes, 2,958,886 to Taylor, 3,965,520 to Maier, 4,075,730 to Siemund, 4,317,250 to Shutts, 4,430, 769 to Bergstrom, 4,495,668 to Adams, 5,140,717 to Castaliola, 5,321,868 and 5,528,793 to Schbot.

Additionally, U.S. Pat. Nos. 3,289,236 to Salka and 3,333,289 to Maughan show, respectively, a painter's edging tool having a paint applying element 26, 26*a* and an oval shaped cleaning brush having conical shaped bristles for cleaning in corners.

While the foregoing mentioned prior art devices provide improvements in the cleaning art, there still remains the need in the art for an easy to use, low-cost device for use in dusting and removing static charge from video display screens. The novel and simplified device of the present invention allows a user to easily and quickly remove dust and static charge from a video display screen by drawing or moving the device back and forth across a screen face with a cleaning brush thereof in contact with the screen. None of the prior art devices discussed above are applicable to cleaning a video display screen, nor could they be used to remove static charge from such a screen.

SUMMARY OF THE INVENTION

Accordingly, it is a general object of the present invention to provide an improved cleaning device. It is a particular object of the present invention to provide a squeegee-like cleaning tool for cleaning video display screens, it is a still more particular object of the present invention to provide a hand held video display screen cleaning device which is moved over the screen a multiple of times to dust the screen and remove static charge therefrom. And, it is a still more particular object of the present invention to provide a hand held video display screen cleaning device having an elongated brush mounted on a body, which body is easily gripped between the thumb and one or more fingers of a single hand of a user for rubbing over a screen to dust the screen and remove static charge therefrom.

In accordance with one aspect of the invention, there is provided a hand held video display screen cleaning tool having a body with an elongated bottom portion secured to a top gripping portion. An elongated brush or cleaning element is secured to the elongated bottom portion for placement on and cleaning of a video display screen by dragging the elongated brush a multiple of times across the video display screen.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
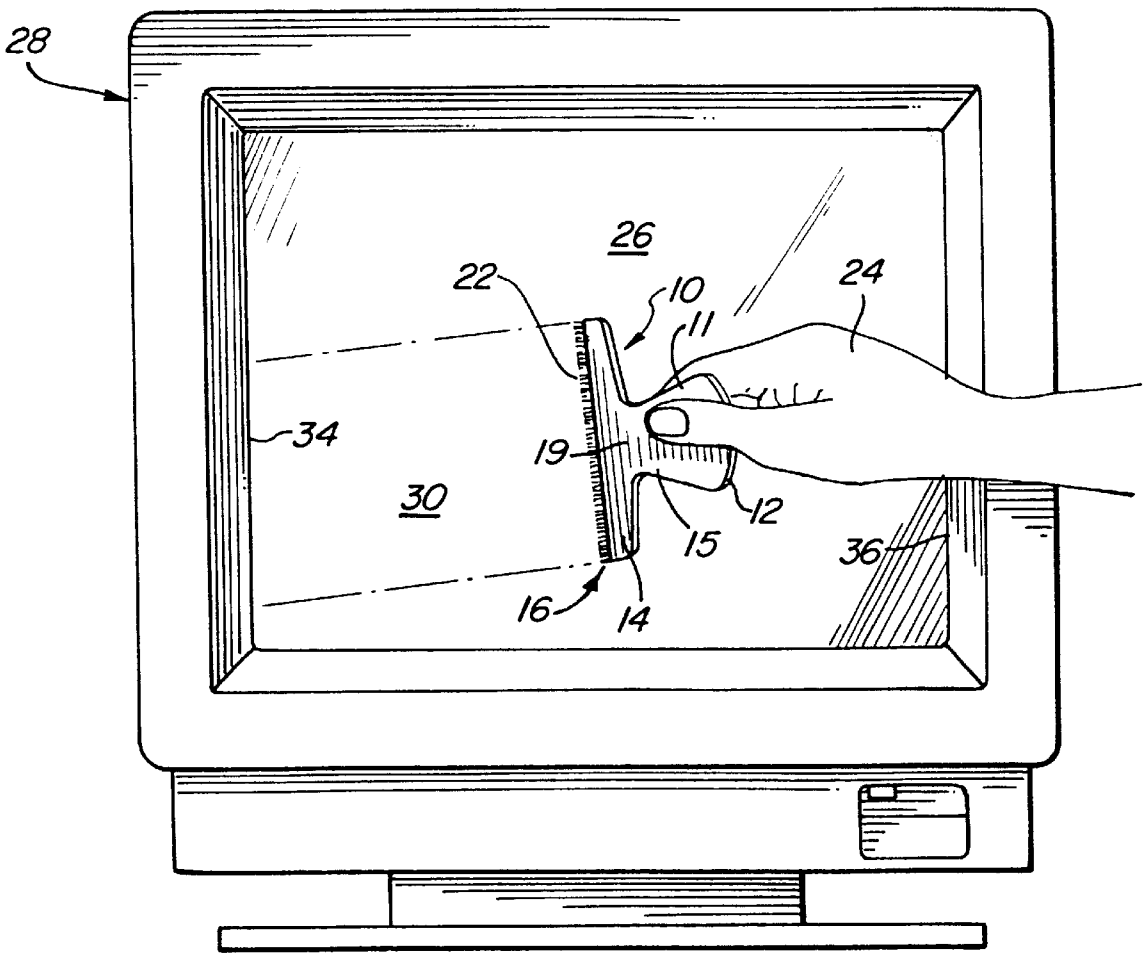
FIG. 1 is a front elevational view of a computer monitor showing a hand of a user holding a screen cleaning device of the present invention against the screen and then dragging it across the screen of the monitor during cleaning.

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for a novel and improved hand held screen cleaning device, generally indicated by numeral 10.

Although the hand held screen cleaning device 10 may take any desired shape, and be made from any available or desired material, it is preferably formed from a single piece of plastic or other similar material, in the form of a thin squeegee-type device. The hand held cleaning device 10 is comprised of a body 11 having a first or upper gripping portion or section 12, a second or lower elongated cleaning portion or section 14, and a connecting or neck portion 15. The elongated cleaning portion 14 is preferably formed in a generally rectangular shape having contoured corners and sloped upper surfaces connected to the neck portion 15 centrally thereof. An elongated brush or cleaning element 16 is secured to a first or rear side 18, as by means of a holding element 17 captured in an elongated opening 21, formed along an angled edge 20 of the elongated lower portion 14 (see FIG. 2). The angle of the edge 20, to which the holding element 17 for brush 16 is bonded or secured, as by an adhesive or the like, is chosen so that it is ergonomic and the bristles 22 of the cleaning brush 16 extend at selected angles to the hand held cleaning device 10 while the device is gripped by a hand 24 of a user during cleaning a video display screen 26 of a computer monitor or the like 28 (see FIG. 1). The ergonomic angle of the edge 20 may vary depending on the size of the hand held device 10, the size of the brush 16 and the length of the bristles 22. That is, the hand held device 10 and brush 16 are sized and dimensioned so that the ergonomic angle of the edge and the length of the brush 16 and bristles 22 are substantially ideal when handled or manipulated by the single hand 24 of a user to be easily and quickly drawn across the screen 26 to efficiently remove particulate matter, such as dust and any static charge from an area 30.

Figure 2:
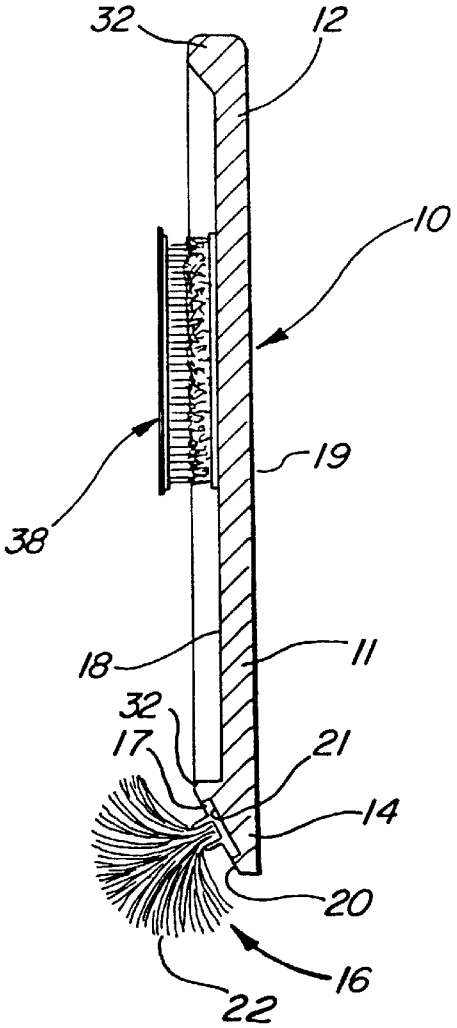
FIG. 2 is a side elevational view, partially in cross-section of a preferred embodiment of the screen cleaning device of the present invention.

The rear face or side 18 of the hand held cleaning device 10 may include a raised portion or bead 32 along its outer edge to add strength thereto, while a front face or surface 19 thereof may take any desired shape, but is preferably flat. As shown in FIG. 2, the first or upper gripping or holding portion 12 and the second or lower elongated, cleaning portion 14 are formed as first and second thin plates having generally coplanar front surfaces defining front surface 19. In this manner the front face 19 may contain advertising, a design, printing, or the like, or may be contoured or otherwise decorated to allow it to be used as an advertising specialty or promotional device.

As shown in FIG. 1, the hand held cleaning device 10 is used to dust and remove static charge from the video display screen 26. This is accomplished by the user grasping the gripping portion 12 in hand 24, between the thumb and one or more fingers thereof. The hand 24 then easily presses the bristles 22 of brush 16 against the CRT screen 26 and moves the hand held cleaning device 10 from a first edge 34 of the monitor 28 over area 30 until the cleaning device reaches a second edge 36 of monitor 28. The cleaning device 10 is then moved back and forth across the screen 26, in the same type of swiping motion to dust and remove static charge from the remainder of the screen.

When a user of the hand held cleaning device 10 moves the device over the screen with the bristles 22 in contact therewith a number of times, depending on the size of the device 10 and the size and shape of the screen 26, dust and static charge will be removed. However, fingerprints or encrusted dirt will not be removed. As discussed above, the cleaning device 10 and brush 16 are designed to be ergonomically efficient, and sized and dimensioned so that the device may be easily gripped by the hand 24 with the bristles 22 pressed against and capable of following any curved or flat video display screen over which it is being drawn. The bristles 22 and brush 16 are preferably formed from a resilient material, such as Nylon, to allow dust and static charge to he removed. The bristles are of sufficient length to clean and conform to either a curved or flat screen, surface for more efficient and thorough cleaning thereof.

When not in use, the hand held cleaning device 10 may be stored out of the way, as by being removably secured to a corner of the computer monitor 28, by a removable securing means 38, such as a loop and fastener system of the type referred to by the trademark VELCRO. This securing means 38 may be secured to the rear surface 18 of the cleaning device, as best shown in FIG. 2.

It therefore can be seen that the present invention provides a simple and easy to manufacture and use hand held cleaning device for dusting and removing static charge from a screen of a computer monitor or other video display device. It is particularly useful by one hand of a user to be dragged or drawn multiple times over a video display screen for efficient and quick cleaning thereof. Furthermore, the device may take any shape so as to be compatible with its surroundings and may have advertising, a design, or other materials, such as a logo applied to an outer side thereof to increase the aesthetics thereof.

Those skilled in the art will appreciate that various adaptations and modifications of the Just-described preferred embodiments can be configured without departing from the scope and spirit of the invention. Therefore, it is to be understood that, within the scope of the appended claims, the invention may be practiced other than as specifically described herein.

What we claim is:

1. A hand held cleaning device for cleaning a video display screen, comprising:

a hand portion generally formed as a first thin plastic plate and adapted for being manually engaged;

a generally rectangular elongate brush holding portion generally formed as a second thin plastic plate and having an obverse side and a reverse side;

an elongate generally narrow brushing element having a plurality of elongated bristles fixedly mounted to the reverse side of the generally rectangular elongate brush holding portion; and the hand portion being formed as one piece with and generally perpendicular to the generally rectangular elongate brush holding portion and extending generally coplanarally therefrom.

2. The hand held cleaning device of claim 1 wherein the first thin plastic plate and second thin plastic plate are coplanar.

3. The hand held cleaning device of claim 1 wherein the reverse side of the second thin plastic plate is angled with respect to the obverse side.

* * * * *